US011644272B1

(12) United States Patent
Cutrer

(10) Patent No.: US 11,644,272 B1
(45) Date of Patent: May 9, 2023

(54) DETACHABLE CHEEK RISER FOR FIREARM STOCK OR BRACE

(71) Applicant: Slade Cutrer, Chesapeake, VA (US)

(72) Inventor: Slade Cutrer, Chesapeake, VA (US)

( * ) Notice: Subject to any disclaimer, the term of this patent is extended or adjusted under 35 U.S.C. 154(b) by 0 days.

(21) Appl. No.: 17/958,861

(22) Filed: Oct. 3, 2022

(51) Int. Cl.
*F41C 23/14* (2006.01)

(52) U.S. Cl.
CPC ..... *F41C 23/14* (2013.01)

(58) Field of Classification Search
CPC ..... F41C 23/06; F41C 23/14; F41C 23/20
See application file for complete search history.

(56) References Cited

U.S. PATENT DOCUMENTS

| | | | | |
|---|---|---|---|---|
| 7,984,580 | B1 | 7/2011 | Giauque et al. | |
| 8,453,365 | B1 * | 6/2013 | Ballard | F41C 23/14 42/74 |
| 2012/0036757 | A1 | 2/2012 | Larue | |
| 2017/0254614 | A1 * | 9/2017 | Moretti | F41C 23/14 |

* cited by examiner

*Primary Examiner* — J. Woodrow Eldred
(74) *Attorney, Agent, or Firm* — Scott D. Smiley; Scott M. Garrett; The Concept Law Group. P.A.

(57) ABSTRACT

A detachable monolithic cheek riser for a firearm stock or brace comprises a top portion having an inside surface that is shaped to match the shape of the top of the stock or brace, and includes side portions that extend downward from the top such that each side portion rests on opposite sides of the stock or brace. At the bottom of the sides of the cheek riser there are retention tabs that extend inward, toward the opposite side, and which are configured to fit into recesses on the sides of the stock or brace when the check riser is attached to the stock or brace. No tool is required to install or remove the cheek riser, as a result.

18 Claims, 8 Drawing Sheets

DETACHABLE CHEEK RISER FOR FIREARM STOCK OR BRACE

FIELD OF THE INVENTION

The invention relates generally to cheek risers for firearm stocks and braces, and more particularly to a cheek riser particularly adapted for firearms using an Armalite Rifle configuration, such as the AR-15, and which includes a stock or brace having recesses on each side of the stock or brace, wherein the inventive cheek riser includes features that engage the recesses to hold the cheek riser in place on the stock or brace without the need for a tool to install or remove the cheek riser.

BACKGROUND OF THE INVENTION

Firearms such as rifles include a stock that extends to the rear from the receiver or action. While aiming and shooting the rifle, the user typically rests their cheek on the top of the stock to steady their view through the sights of the rifle. Often a magnified optic such as a scope will be used, which is mounted over the action. The height of the scope over the action is often such that it is not easy, or not possible, for the user to place their cheek on the top of the stock and comfortably look through the scope. This problem has been addressed in several ways. Some stocks have a height-adjustable comb built into the stock that the user can raise to a height that is comfortable for them. Another way this problem is addressed is with a cheek riser, which is an article that is attached to the top of the stock at the comb, where the user places their cheek. It is common, for some users with particular firearms, to simply place a compliant material on the top of the stock and hold it in place with something (e.g. tape). However this does not allow easy removal or adjustment of the cheek riser. There are many aftermarket detachable cheek risers that require a tool to install/remove. However, these then require the user to keep the tool with the rifle, and using the tool takes time. In a combat situation, this is not acceptable.

Therefore, a need exists to overcome the problems with the prior art as discussed above.

SUMMARY OF THE INVENTION

In accordance with some embodiments of the inventive disclosure, there is provided a detachable cheek riser for a firearm that includes a body having a length from a first end to a second end. The body has an inverted "U" or "V" shape along its length and defines a top and an inner surface. The detachable cheek riser further includes a first side that extends downward from the top to a first bottom and a second side that extends downward from the top to a second bottom that is opposite the first bottom relative to the top. The detachable cheek riser further includes at least one retention tab at the first bottom that extends inward, in a direction of the second side, that is configured to fit into at least one recess on a first side of a stock or brace of the firearm, and at least one retention tab at the second bottom that extends inward, in a direction of the first side, that is configured to fit into at least one recess on a second side of the stock or brace of the firearm.

In accordance with a further feature, the at least one retention tab at the first bottom and the at least one retention tab at the second bottom are co-aligned along the length of the body and are positioned closer to the second end of the body than to the first end of the body.

In accordance with a further feature, the body has the inverted "U" configuration, the firearm has a stock that is movable between a fully collapsed position and a fully extended position, the firearm further comprises a charging handle that moves over the stock when pulled by a user to charge the firearm, the at least one retention tab at the first bottom and the at least one retention tab at the second bottom are positioned along the first and second bottoms, respectively such that, when the cheek riser is oriented in a first position with the second end of the body closest to the charging handle, the cheek riser is positioned on the stock such that the charging handle can be fully extended without interference by the cheek riser.

In accordance with a further feature, he at least one retention tab at the first bottom comprises a first retention tab at the first end of the body at the first bottom and a second retention tab at the second end of the body at the first bottom, and the at least one retention tab at the second bottom comprises a first retention tab at the first end of the body at the second bottom and a second retention tab at the second end of the body at the second bottom.

In accordance with a further feature, the body has the inverted "U" shape, the inside surface of the body is configured to conform to an outside surface of the stock.

In accordance with a further feature, on the inside surface, there is a flat wall section the extends upward from the first bottom on the first side, and there is a flat wall section that extends upward from the second bottom on the second side.

In accordance with a further feature, the cheek riser further includes a cushion between the inside surface and an outside surface at the top.

In accordance with a further feature, the first side, first bottom, second side, and second bottom extend along the entire length of the body.

In accordance with some embodiments of the inventive disclosure, there is provided a detachable cheek riser for a firearm that includes a body having a length of not more than one hundred millimeters from a first end to a second end, the body having an inverted "U" or "V" shape along the length and defining a top. The cheek riser includes a first side that extends downward from the top to a first bottom and a second side that extends downward from the top to a second bottom that is opposite the first bottom relative to the top, wherein the first and second bottoms are spaced apart from each other. The cheek riser has an inner surface of the body defined along the first and second sides and the top where the first and second sides face each other. The cheek riser further includes at least one retention tab at the first bottom that extends inward, in a direction of the second side, that is configured to fit into at least one recess on a first side of a stock or brace of the firearm, and at least one retention tab at the second bottom that extends inward, in a direction of the first side, that is configured to fit into at least one recess on a second side of the stock or brace of the firearm.

In accordance with a further feature, the at least one retention tab at the first bottom and the at least one retention tab at the second bottom are co-aligned along the length of the body and are positioned closer to the second end of the body than to the first end of the body.

In accordance with a further feature, the body has the inverted "U" configuration, the firearm has a stock that is movable between a fully collapsed position and a fully extended position, the firearm further comprises a charging handle that moves over the stock when pulled by a user to charge the firearm, the at least one retention tab at the first bottom and the at least one retention tab at the second bottom are positioned along the first and second bottoms, respectively such that, when the cheek riser is oriented in a first position with the second end of the body closest to the charging handle, the cheek riser is positioned on the stock such that the charging handle can be fully extended without interference by the cheek riser.

In accordance with a further feature, the at least one retention tab at the first bottom comprises a first retention tab at the first end of the body at the first bottom and a second retention tab at the second end of the body at the first bottom, and the at least one retention tab at the second bottom comprises a first retention tab at the first end of the body at the second bottom and a second retention tab at the second end of the body at the second bottom.

In accordance with a further feature, the body has the inverted "U" shape, the inside surface of the body is configured to conform to an outside surface of the stock.

In accordance with a further feature, on the inside surface, there is a flat wall section the extends upward from the first bottom on the first side, and there is a flat wall section that extends upward from the second bottom on the second side.

In accordance with a further feature, the cheek riser further includes a cushion between the inside surface and an outside surface at the top.

In accordance with a further feature, the first side, first bottom, second side, and second bottom extend along the entire length of the body.

In accordance with some embodiments of the inventive disclosure, there is provided a detachable cheek riser for a stock for a firearm. The stock is configured to mount on a buffer tube of the firearm and is moveable on the buffer tube between a fully collapsed position and a fully extended position. The firearm has a charging handle that has a length of travel parallel to the buffer tube along a line of travel over the stock at a travel height. The stock has a top portion and opposing sides, where each one of the sides has a recess that extends inward. The cheek riser includes a body having a length of not more than one hundred millimeters from a first end to a second end. The has an inverted "U" shape along its length, and defining a top. The cheek riser includes a first side that extends downward from the top to a first bottom, and a second side that extends downward from the top to a second bottom that is opposite the first bottom relative to the top. The first and second bottoms are spaced apart from each other. The cheek riser further includes an inner surface of the body defined along the first and second sides and the top where the first and second sides face each other. The inner surface is shaped to match a shape of the top portion of the stock. The cheek riser further includes at least one retention tab at the first bottom that extends inward, in a direction of the second side, that is configured to fit into the recess on a first side of the stock, and at least one retention tab at the second bottom that extends inward, in a direction of the first side, that is configured to fit into a recess on a second side of the stock. The at least one retention tab at the first bottom and the at least one retention tab at the second bottom are co-aligned along the length of the body and are positioned closer to the second end of the body than to the first end of the body. When the stock is in the fully collapsed position and the cheek riser is oriented with the second end closest to the charging handle, the charging handle can be operated over its entire length of travel without contacting the cheek riser.

In accordance with a further feature, on the inside surface of the body of the cheek riser there is a flat wall section the extends upward from the first bottom on the first side, and there is a flat wall section that extends upward from the second bottom on the second side.

In accordance with a further feature, the cheek riser also includes a cushion between the inside surface and an outside surface at the top of the cheek riser.

In accordance with a further feature, the first side, first bottom, second side, and second bottom extend along the entire length of the body.

Although the invention is illustrated and described herein as embodied in a detachable cheek riser for a firearm stock or brace, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure, but otherwise include a range of about +/−10%. In this document, the term "longitudinal" should be understood to mean in a direction corresponding to an elongated direction of the article, component, section, or portion being references. The terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1A:
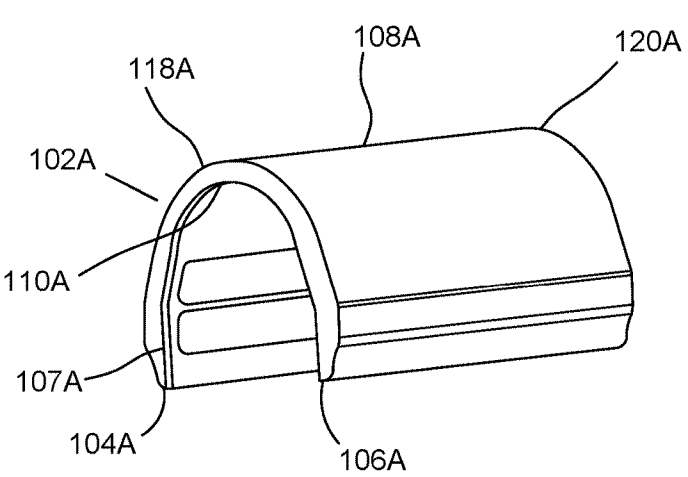
FIGS. 1A-1D show perspective view of various exemplary cheek risers for firearm stocks and braces, in accordance with some embodiments.
Figure 1B:
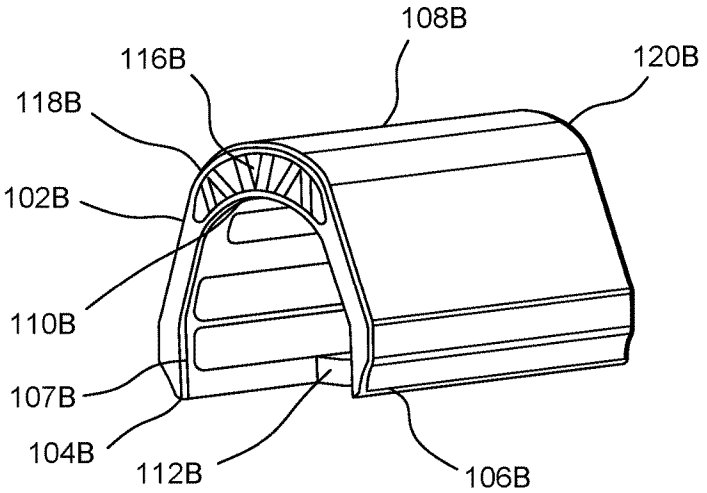
Figure 1C:
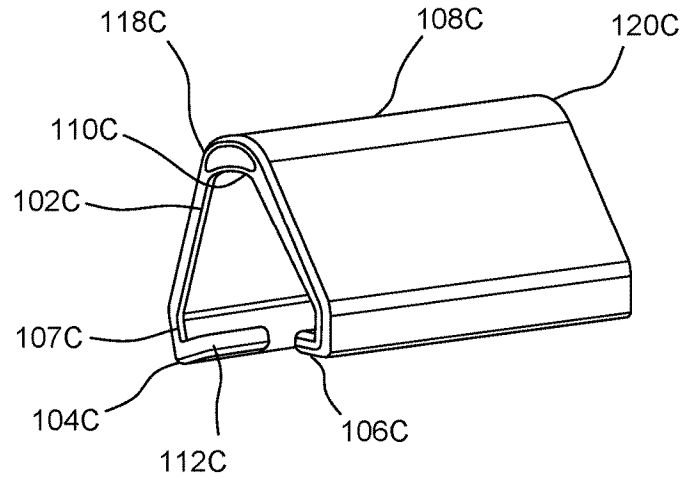
Figure 1D:
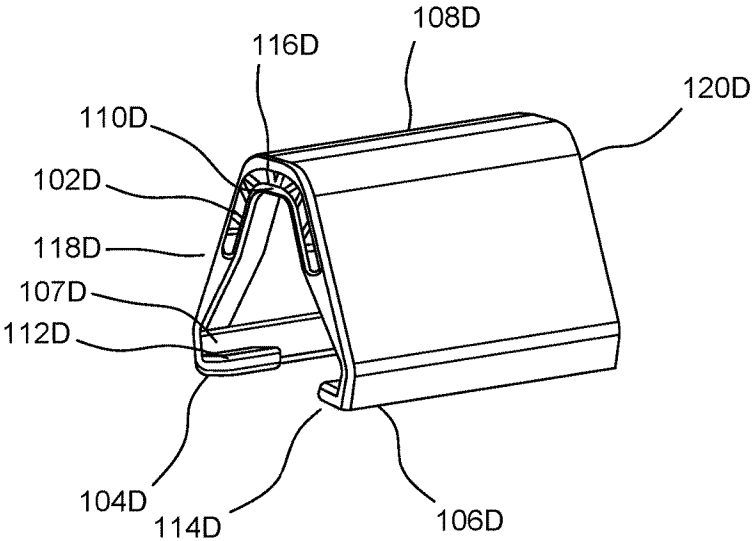

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The inventive cheek riser is a monolithic article that is tool free, and easily placed on, or removed from certain rifle stocks having features that can be utilized by the cheek riser to retain itself on the stock. In particular, the embodiments of the inventive cheek riser are for AR-15 type rifles and other weapons using the AR-15 platform. The inventive cheek riser eliminates the need for a tool to install or remove the cheek riser. Furthermore, the cheek riser, in some embodiments, can have two different mounting orientations on the stock, in which, in a first orientation the charging handle of the rifle can be cycled without interference from the cheek riser, and in a reverse orientation, the stock has to be extended to avoid interference with the charging handle.

FIGS. 1A-1D show perspective view of various exemplary cheek risers 102A-102D for firearm stocks and braces, in accordance with some embodiments. Cheek risers 102A and 102B are for a stock, while cheek risers 102C and 102D are for a brace. As used herein the term "stock" refers to the portion of a long gun, such as a rifle, that is held up to the user's shoulder when firing the gun. The term "brace" refers to a rear extension of a pistol type firearm that can be attached to a user's forearm to stabilize the firearm when shooting the firearm. In some cases, a brace can be used on a rifle, however braces are not intended to be used as a stock, and therefore may not have a comfortable top surface on which a user can rest their cheek. A cheek riser can alleviate that, as well as raise the user's head for comfortably viewing through an optic mounted on the rifle. Because the cheek risers 102A-120D share many common features, reference numerals with alphabetic suffixes are used across the drawings. Where a reference numeral is used without the alphabetic suffix it can be assumed that all of the cheek risers 102A-102D have the feature being referenced with the addition of the appropriate suffix. Thus all of the reference numerals of check riser 102A have an "A" suffix, and likewise for cheek risers 102B, 102C, and 102D. Furthermore, in describing the structures of the cheek riser 102, reference should also be made to FIGS. 2A-2F, and 3A-3D as these show the same cheek risers 102A-102D from various other views.

Each of the cheek risers 102A-102D have, from an end view, such as when looking at either end 118 or end 120, a generally inverted "U" or "V" shape that extends along the entire length of the body, from the first end 118 to the second end 120. The cheek risers 102A-102B use an inverted "U" shape for attaching to a stock, while cheek risers 102C and 102D use an inverted "V" shape for a brace. The stock can be, for example, those sold under the trade names MOE CARBINE STOCK and the CTR CARBINE STOCK by MAGPUL, INC. The body of each cheek riser 102A-102D defines a top 108. While the top 108 can have an uppermost point, the top also refers to a portion of the body that spans a width across the body in a direction perpendicular to the length of the body, and also along the length of the body. A first side extends downward from the top 108 to a first bottom 104, and a second side extends downward from the top 108 to a second bottom 106. An inner surface 110 of the top 108 is contiguous with the inner surfaces of the first and second side. The cheek riser 102 can have a flat wall section 107, 109 at the inner surfaces of the first and second sides that extend upward a short distance that is configured to rest against similar flat portion of the stock or brace to which the cheek riser is attached.

Figure 2B:
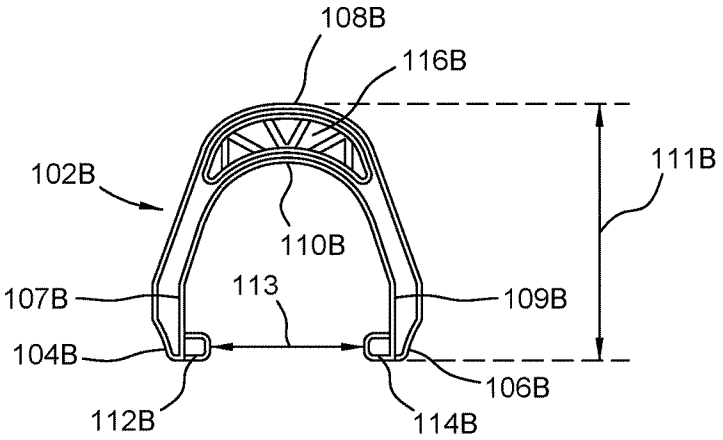
FIGS. 2A-2D show end elevational views of various exemplary cheek risers for firearm stocks and braces, in accordance with some embodiments.
Figure 2D:
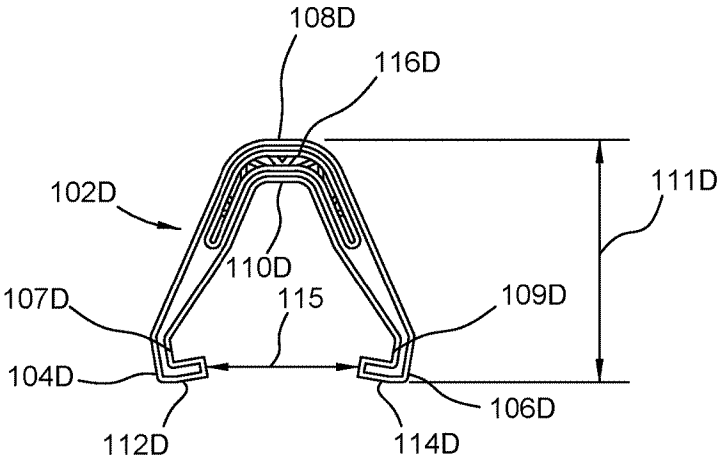
Figure 2A:
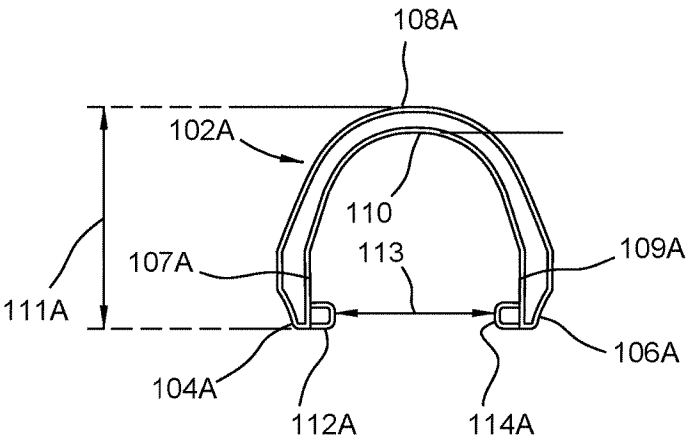
Figure 2C:
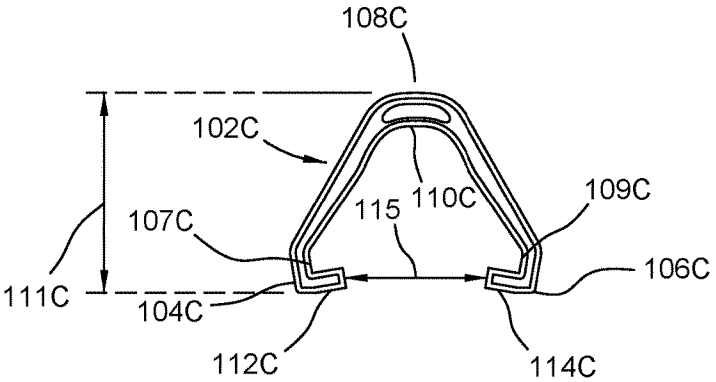

At the bottoms 104, 106 there is at least one retention tab 112 on the first side at the first bottom 104, and at least one retention tab 114 on the second side at the second bottom 106. The retention tabs 112, 114 are sized to fit into corresponding horizontal recesses formed in the opposite sides of the stock/brace. For the cheek risers configured to fit on a stock, the retention tabs 112A, 114A have a configuration as shown in FIG. 2E, where the tabs 112A, 114A are positioned closer to the second end 120 than to the first end 118. Thus, distance 119A is longer than distance 121A. The tabs 112A, 114A on each side 104A, 106A have the same length, width and height. As a result, the cheek riser 102A can be placed on the stock in two different orientations, with either first end 118A forward or second end 120A forward. The body of the cheek risers 102A, 102*b* can have an overall length 122A, B of about eighty five millimeters, distance 119A can be on the order of forty two to forty three millimeters, distance 121A can be on the order of fifteen to sixteen millimeters, and the length of the tabs 112A, 114A can be about twenty seven millimeters.

Figure 2F:
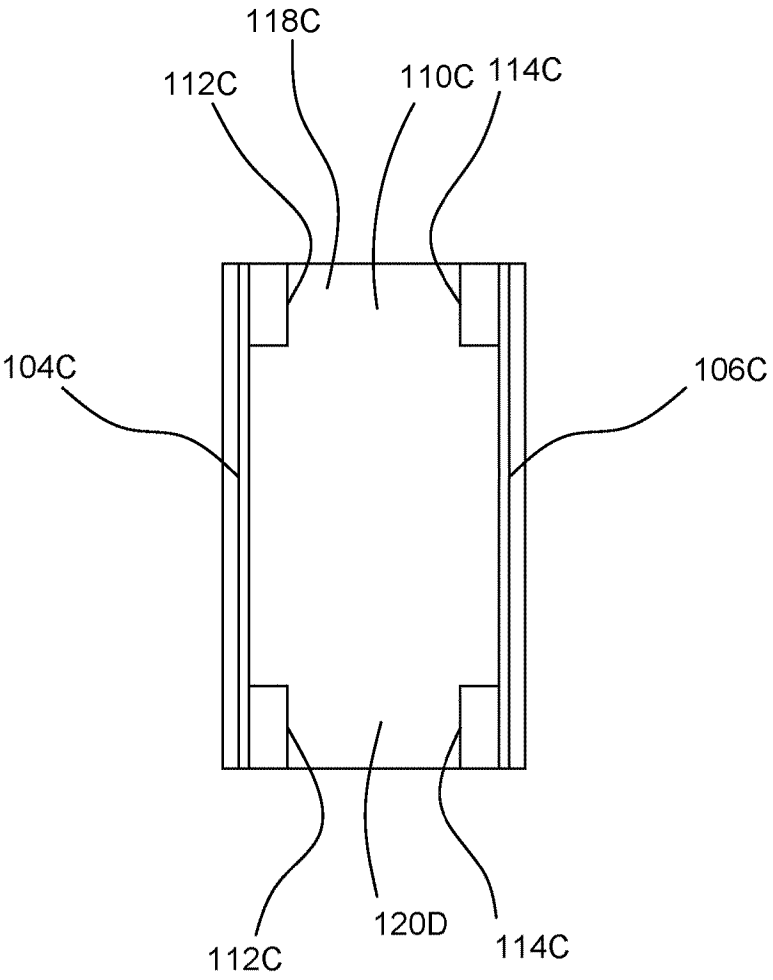
FIGS. 2E-2F show bottom views of various exemplary cheek risers for firearm stocks and braces, in accordance with some embodiments.
Figure 2E:
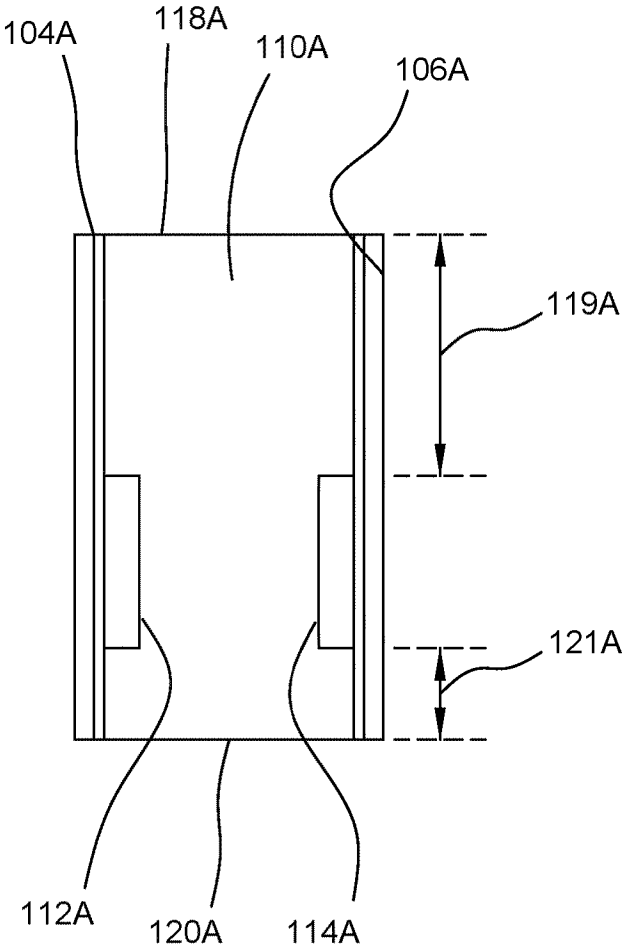
Figure 3B:
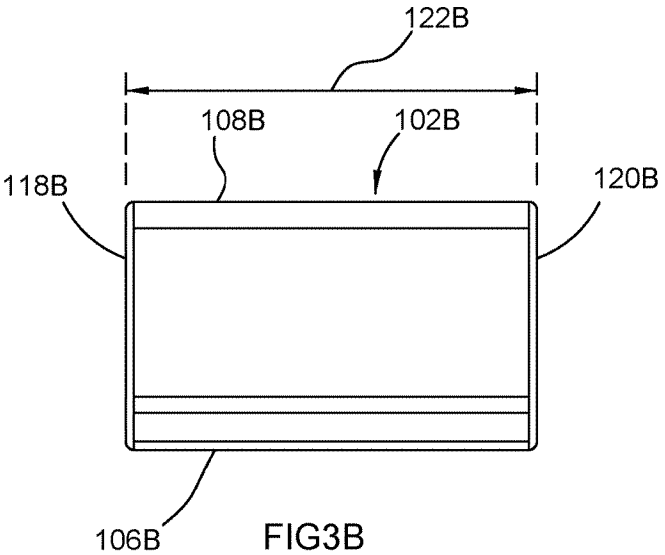
FIGS. 3A-3D show side elevational views of various exemplary cheek risers for firearm stocks and braces, in accordance with some embodiments.
Figure 3D:
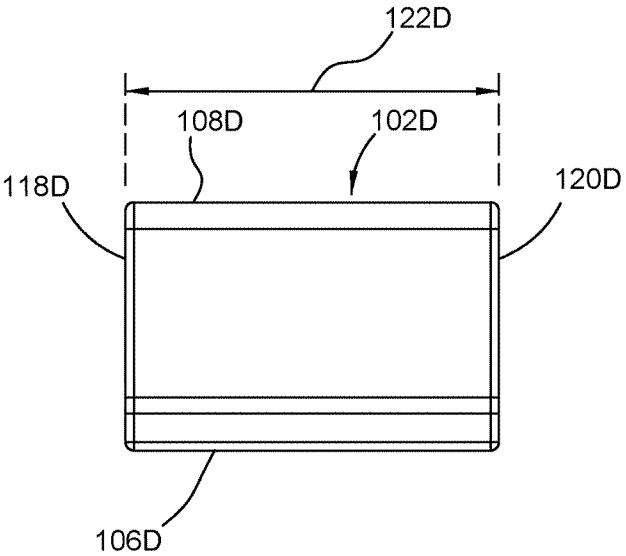
Figure 3A:
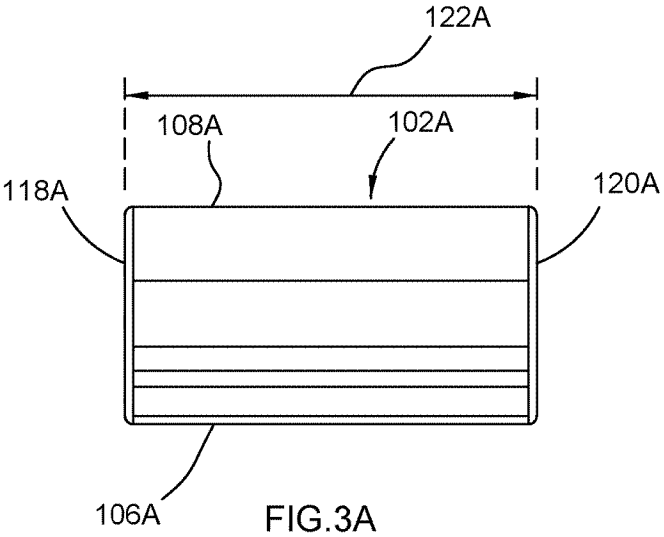
Figure 3C:
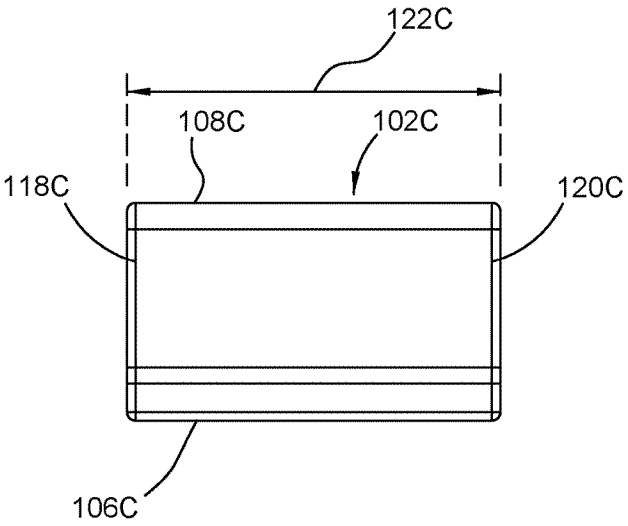

In FIG. 2F the bottom view of cheek riser 102C is shown, but cheek riser 102D is substantially identical. These cheek risers 102C, 102D are configured to fit on a commercial brace such as that sold under the trade name SBA3 sold by SB TACTICAL, INC. In these cheek risers 102C, 102D, there are two retention tabs 112 on the first side, and two retention tabs 114 on the second side, with one at each end 118, 120 on each side at the bottoms 104, 106. These cheek risers 102C, 102D do not have an orientation, so placing them on the brace with either the first end 118 or the second end 120 forward does not change the resulting position of the cheek riser on the brace.

In FIGS. 2A-2D, and in FIG. 3A-3D, the height 111, length 122 are shown. For the stock type cheek risers 102A-102B, the height 111A,B can range from about 36.75 mm to 49.5 mm, or more. At around 36 to 37 mm the top 108A,B is simply a wall of the same material used to make the sides, with no cushion. To raise the height and at the same time provide some compressibility of the top 108, a cushion 116 can be formed in the top 108. The cushion can be a section of reduced density between the inner surface 110 and the outer surface of the top 108. In some embodiments the cushion can be formed by an air space that includes a series of ribs or walls that run the length of the cheek riser in the top portion. While the height 111 can change to accommodate different heights of the optic mounted on the firearm, the distance 113 between the retention tabs 112, 114 does not vary for cheek risers designed for a particular model of stock since the distance between the opposing recesses will be consistent. For cheek risers 102C, 102D designed for attachment to a brace, the can have an overall length 122C, D of about seventy six millimeters, and a height 111C, D varying from about thirty eight to fifty one millimeters. The distance 115 between the retention tabs 112, 114 can be about thirty one millimeters, although this distance 115 is dictated by the design of the particular brace to which the cheek riser 102C, 102D is being attached.

Figure 4A:
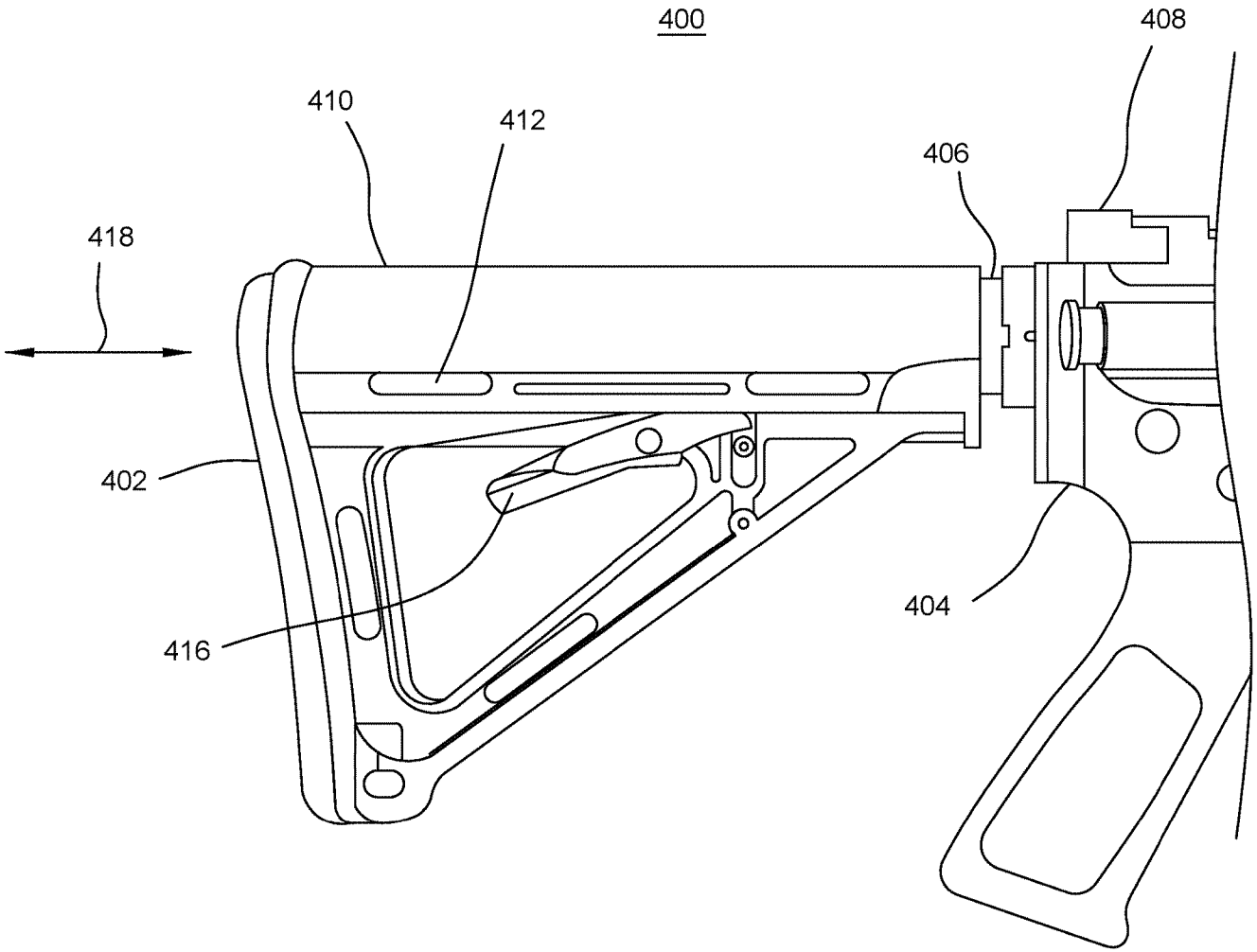
PRIOR ART FIG.4A
FIG. 4A shows an example of a firearm stock in accordance with the prior art.

FIG. 4A shows an example of a firearm stock 402 in accordance with the prior art. The stock 402 is attached to an AR-15 type carbine or rifle. A buffer tube 406 is threaded into the back of a lower receiver 404, and extends from the lower receiver along an axis of travel of the buffer and the bolt carrier group, as is well known. The buffer tube 406 can include a series of catches along the bottom of the buffer tube that can each be selectively engaged by a moveable pin in the stock. A spring biased lever 416 moves the pin out of a catch so that the stock 402 can be moved along the buffer tube 406 as indicated by arrow 418 to a desired position, from a fully "collapsed" position where the stock 402 is closest to the receiver 404 (as shown here), to a fully extended position where the stock is at the furthest position of its range of motion along the buffer tube. The stock 402 includes a rounded top surface 410 that is rounded in a direction perpendicular to the direction of arrow 418. Along the side of the stock, adjacent the lower end of the top surface 410, are recesses 412 on each side of the stock. Retention tabs 112, 114 cheek risers 102A, 102B are sized to fit snugly inside the recesses 412. The cheek risers 102 are made of resilient material, such as, for example, rubber, which allows the bottoms 104, 106 to be moved apart from a neutral position, as shown in FIGS. 2A, 2B, while still urging them back to their neutral position, to fit the retention tabs 112, 114 over the top surface 410 of the stock 402.

Figure 4B:
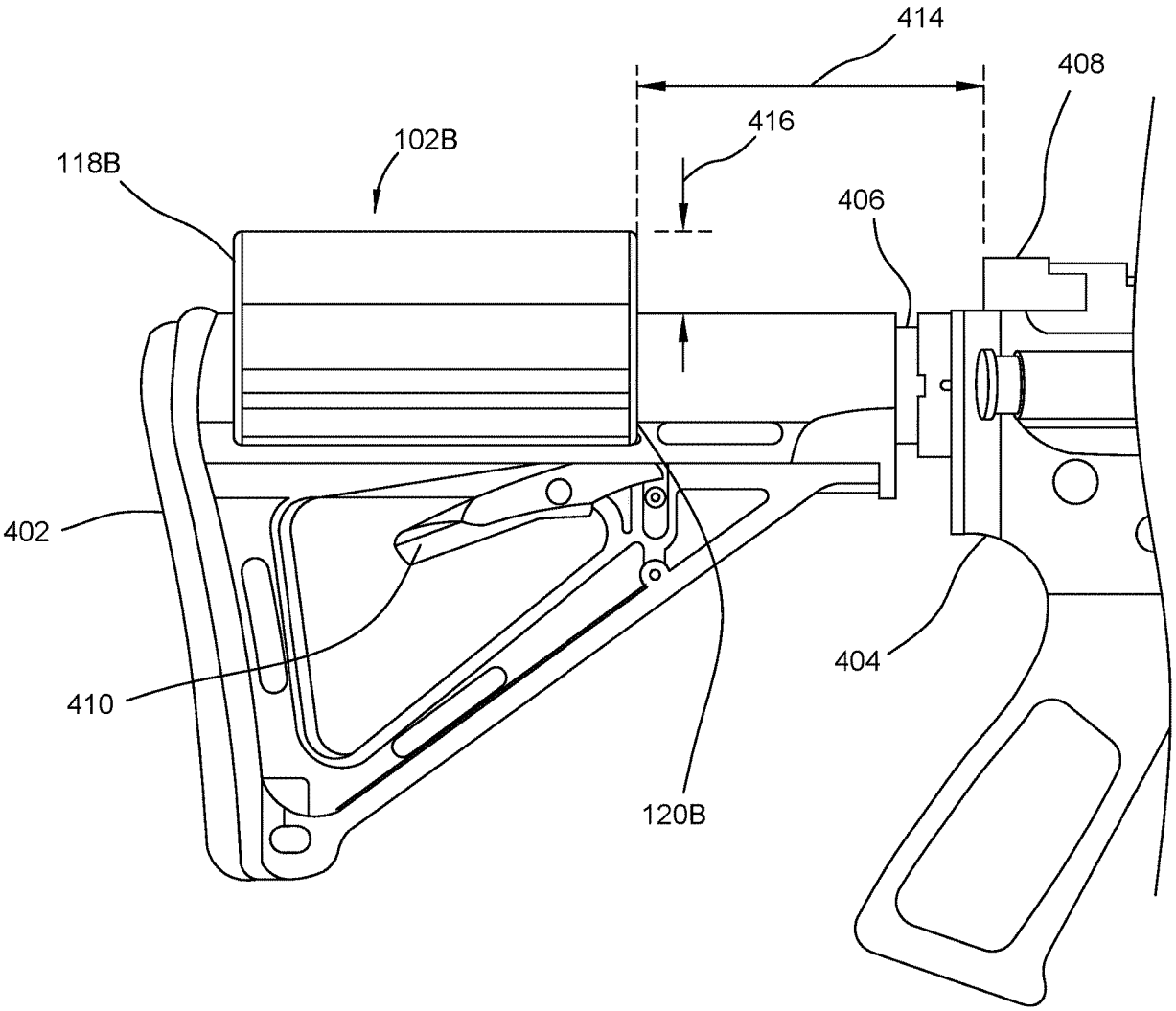
FIG. 4B shows the prior art firearm stock with a cheek riser in accordance with some embodiments of the inventive disclosure attached to the stock.

When the retention tabs 112, 114 reach the recesses 412, the material of the cheek risers urges the bottoms together toward their neutral position, which can be slightly less than the width of the stock 402 to ensure a snug fit and retention of the cheek riser 102 onto the stock, as shown in FIG. 4B. In FIG. 4B the cheek riser 102B is attached to the stock 402, meaning the retention tabs 112B, 114B are seated into the recesses 412 on each side of the stock, and the natural bias of the sides of the body of the cheek riser 102B holds the retention tabs 112B, 114B in the recesses and the inner surface 110B snugly against the top surface 410 of the stock 402. The resiliency of the material of the cheek riser eliminates the need for a tool to, for example, adjust a screw or bolt to hold the cheek riser on the stock. Instead, the natural tendency of the material to return to its neutral position acts to hold the cheek riser in place, when the retention tabs are properly seated in corresponding recess features of the stock.

If the second end 102B of the cheek riser 102B is closest to the receiver 404, the charging handle 408 can be moved its full travel length as the distance 414 between the second end of the cheek riser 102B and the charging handle in its standard position is greater than the full travel length of the charging handle, which is about 3.8 inches. The cheek riser 102B has a height 416 between the inner surface at the top portion and the top at the outer surface such that the top portion of the cheek riser 102B is in the line of travel of the charging handle. This means that if the cheek riser 102B were within the travel distance 414 of the charging handle 408, the charging handle 408 would contact the cheek riser 102B and not be able to complete the charging operation. But with the second end 120B oriented closest to the charging handle 408, most of the body of the cheek riser 102B is behind the recess 412 (i.e. farther from the charging handle), which allows the charging handle to travel over its full travel range and not contact the cheek riser 102B even with the stock 402 in the fully collapsed position.

Figure 5:
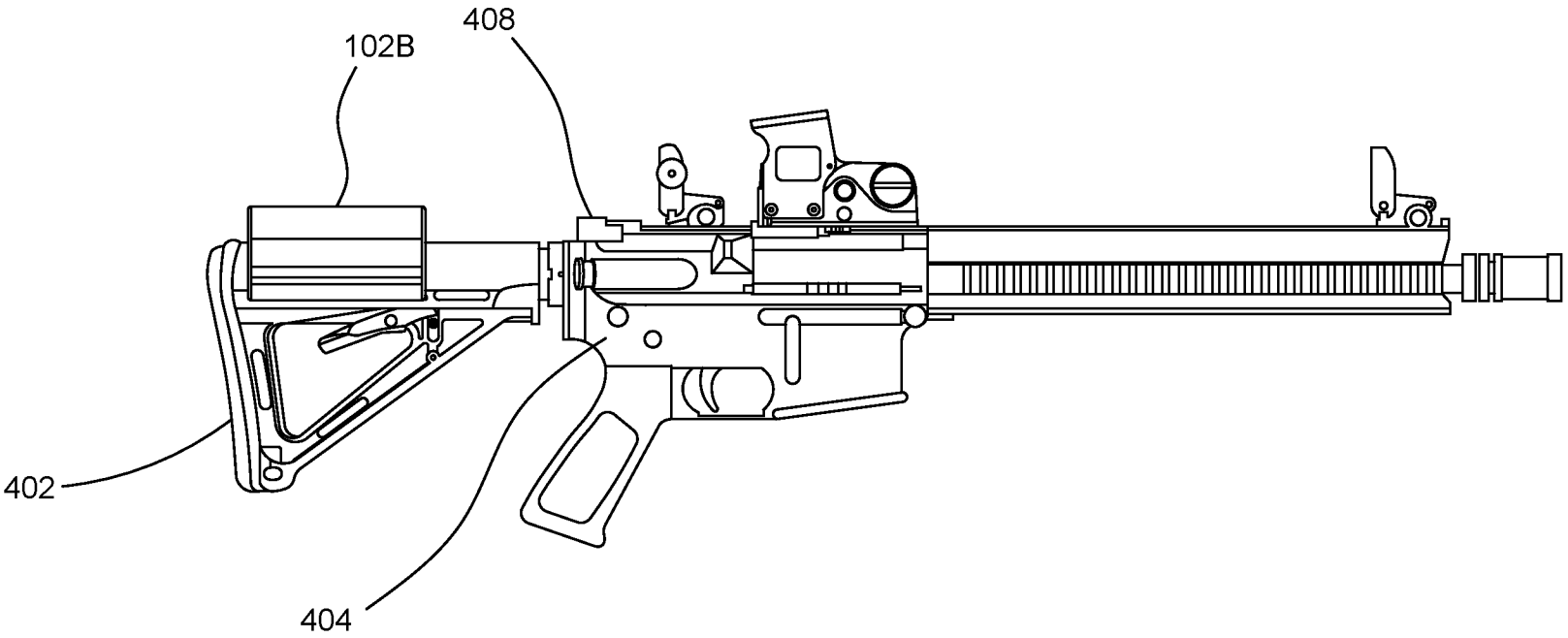
FIG. 5 shows an example of a carbine rifle having a cheek riser in accordance with some embodiments of the inventive disclosure attached to the stock of the carbine.

If the user prefers a more forward position of the cheek riser 102B, the cheek riser 102B can be turned around so that the first end 118B is closest to the receiver 404. However, in that orientation, the stock 404 will have to be extended in order for the charging handle 408 to be fully cycled. FIG. 5 shows a complete carbine with a cheek riser 102B on the stock 402. As mentioned, other cheek risers can be used that have varying heights to allow the user to select an optimum height for a given optic mounted on the upper receiver.

Figure 6B:
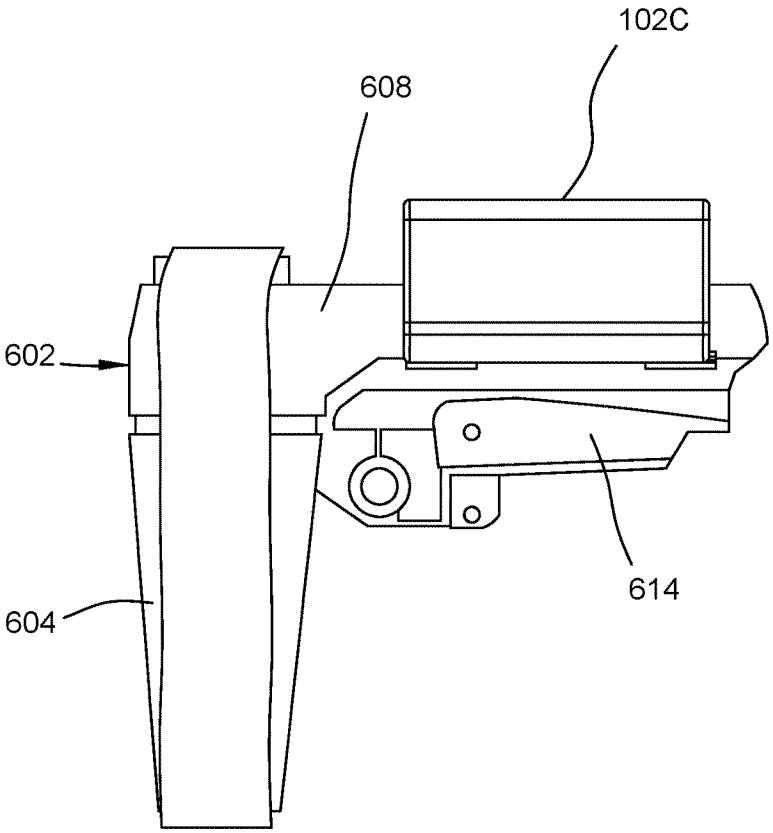
FIG. 6B shows the prior art firearm brace with a cheek riser in accordance with some embodiments of the inventive disclosure attached to the brace.
Figure 6A:
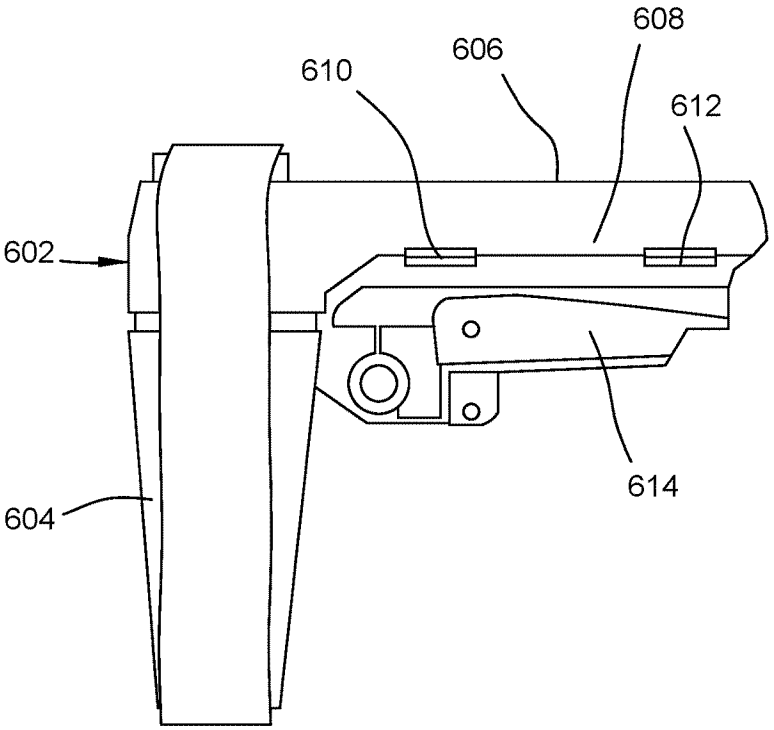
FIG. 6A shows an example of a firearm brace in accordance with the prior art.

FIG. 6A shows an example of a firearm brace 602 in accordance with the prior art. The brace 602, like a stock, fits onto the buffer tube of a firearm, or the mechanical equivalent of a buffer tube, and is used to stabilize large pistol-type firearms, such as pistols based on the AR-15 platform. A common example of a brace is that sold under the trade name SBA3 by SB TACTICAL, INC. The brace 602 includes a forearm cinch 604 that includes a strap 604 configured to fit around a user's forearm. However, because the brace 602 will fit on a standard AR-15 carbine buffer tube, some people have chosen to use them on rifles, or AR-15 pistols that have been legally converted to short barreled rifles. Accordingly, a cheek riser may be desirable to use on the brace 602. The brace 602 includes a top surface 606 that may be more triangular shaped than the rounded top surface of a stock. That is because the brace 602 is not intended to be used as a stock, which further necessitates the need for a cheek riser, simply for comfort, when the brace is used on a rifle and shouldered like a stock. This is also why some embodiments of the cheek riser 102 have the inverted "V" shape instead of the inverted "U" shape. The brace 602 also includes flat side portions 608 on either side of the brace 602, which meet the top portion 606 along the length of the top portion 606. Further, on each side of the brace 602, along the bottom of the flat side portions 608, there are recesses 610, 612 on each side of the brace 602. Further, as with a stock, the brace 602 can have an adjustment lever 614 that allows the brace to be moved along the buffer tube to allow the user to adjust the length of pull to the desired position. Further, because the cheek riser attached to the brace 602 will interfere with the travel of the charging handle, the brace 602 will have to be moved in order to provide clearance when operating the charging handle. FIG. 6B shows the prior art firearm brace 602 a cheek riser 102C mounted on the top portion 608 of the brace 602. The retention tabs 112, 114 on the cheek riser 102C are positioned to fit into the recesses 610, 612, and hold the cheek riser 102C onto the brace 602. The resiliency of the material of the cheek riser provides a spring action such that when the sides of the cheek riser and moved apart from their neutral position to fit over the top portion 608 of the brace 602, the opposing sides are urged together, holding the retention tabs 112, 114 in the recesses 610, 612 on both sides of the brace 602, which as a result holds the cheek riser 102C in place as mechanical interference between the retention tabs 112, 114 and sides of the recesses 610, 612 prevent movement of the cheek rise 102C.

A detachable cheek riser for a firearm stock or brace has been disclosed that is configured to fit over the top portion of the stock or brace, and retained on the stock or brace by a combination of retention tabs that engage into recesses formed into the sides of the stock or brace, as well as the natural spring action of the resilient material of the cheek riser. This eliminates the need for any tool to be used to attach, or release the cheek riser to/from the stock/brace. As a result, the cheek riser can be quickly installed or removed. Further, in some embodiments, the cheek riser can allow cycling of the charging handle of the weapon when the stock is fully collapsed, which allows use of the cheek riser in certain combat operations, such as close quarters battle, room clearing, and so on.

The claims appended hereto are meant to cover all modifications and changes within the scope and spirit of the present invention.

What is claimed is:

1. A detachable cheek riser for a firearm, comprising:

a body having a length from a first end to a second end, the body having an inverted "U" or "V" shape along the length and defining a top and an inner surface;

the body having a first side that extends downward from the top to a first bottom;

the body having a second side that extends downward from the top to a second bottom that is opposite the first bottom relative to the top;

the body having a first retention tab at the first end of the body at the first bottom and a second retention tab at the second end of the body at the first bottom that both extend inward, in a direction of the second side, and that are each configured to fit into corresponding recesses on a first side of a stock or brace of the firearm; and the body having a first retention tab at the first end of the body at the second bottom and a second retention tab at the second end of the body at the second bottom that both extend inward, in a direction of the first side, and that are configured to fit into corresponding recesses on a second side of the stock or brace of the firearm;

wherein the body has a resiliency that causes the at least one retention tab at the first bottom to be urged into the at least one recess on the first side of a stock or brace of the firearm, and the at least one retention tab at the second bottom to be urged into the at least one recess on the second side of the stock or brace of the firearm, and wherein no tool is required to place the body on the stock or brace of the firearm.

2. The detachable cheek riser of claim 1, wherein the at least one retention tab at the first bottom and the at least one retention tab at the second bottom are co-aligned along the length of the body and are positioned closer to the second end of the body than to the first end of the body.

3. The detachable cheek riser of claim 2, wherein the body has the inverted "U" configuration, the firearm has a stock that is movable between a fully collapsed position and a fully extended position, the firearm further comprises a charging handle that moves over the stock when pulled by a user to charge the firearm, the at least one retention tab at the first bottom and the at least one retention tab at the second bottom are positioned along the first and second bottoms, respectively such that, when the cheek riser is oriented in a first position with the second end of the body closest to the charging handle, the cheek riser is positioned on the stock such that the charging handle can be fully extended without interference by the cheek riser.

4. The detachable cheek riser of claim 1, wherein the body has the inverted "U" shape, the inside surface of the body is configured to conform to an outside surface of the stock.

5. The detachable cheek riser of claim 1, wherein, on the inside surface, there is a flat wall section the extends upward from the first bottom on the first side, and there is a flat wall section that extends upward from the second bottom on the second side.

6. The detachable cheek riser of claim 1, further comprising a cushion between the inside surface and an outside surface at the top.

7. The detachable cheek riser of claim 1, wherein the first side, first bottom, second side, and second bottom extend along the entire length of the body.

8. A detachable cheek riser for a firearm, comprising:

a body having a length of not more than one hundred millimeters from a first end to a second end, the body having an inverted "U" or "V" shape along the length and defining a top;

a first side that extends downward from the top to a first bottom;

a second side that extends downward from the top to a second bottom that is opposite the first bottom relative to the top, wherein the first and second bottoms are spaced apart from each other;

an inner surface of the body defined along the first and second sides and the top where the first and second sides face each other;

a first retention tab at the first end of the body at the first bottom and a second retention tab at the second end of the body at the first bottom that both extend inward, in a direction of the second side, and that are each configured to fit into corresponding recesses on a first side of a stock or brace of the firearm; and the body having a first retention tab at the first end of the body at the second bottom and a second retention tab at the second end of the body at the second bottom that both extend inward, in a direction of the first side, and that are configured to fit into corresponding recesses on a second side of the stock or brace of the firearm.

9. The detachable cheek riser of claim 8, wherein the at least one retention tab at the first bottom and the at least one retention tab at the second bottom are co-aligned along the length of the body and are positioned closer to the second end of the body than to the first end of the body.

10. The detachable cheek riser of claim 9, wherein the body has the inverted "U" configuration, the firearm has a stock that is movable between a fully collapsed position and a fully extended position, the firearm further comprises a charging handle that moves over the stock when pulled by a user to charge the firearm, the at least one retention tab at the first bottom and the at least one retention tab at the second bottom are positioned along the first and second bottoms, respectively such that, when the cheek riser is oriented in a first position with the second end of the body closest to the charging handle, the cheek riser is positioned on the stock such that the charging handle can be fully extended without interference by the cheek riser.

11. The detachable cheek riser of claim 8, wherein the body has the inverted "U" shape, the inside surface of the body is configured to conform to an outside surface of the stock.

12. The detachable cheek riser of claim 8, wherein, on the inside surface, there is a flat wall section the extends upward from the first bottom on the first side, and there is a flat wall section that extends upward from the second bottom on the second side.

13. The detachable cheek riser of claim 8, further comprising a cushion between the inside surface and an outside surface at the top.

14. The detachable cheek riser of claim 8, wherein the first side, first bottom, second side, and second bottom extend along the entire length of the body.

15. A detachable cheek riser for a stock for a firearm, the stock being configured to mount on a buffer tube of the firearm and be moveable on the buffer tube between a fully collapsed position and a fully extended position, the firearm having a charging handle having a length of travel parallel to the buffer tube along a line of travel over the stock at a travel height, the stock having a top portion and opposing sides each one of the sides having a recess that extends inward, the cheek riser comprising:

a body having a length of not more than one hundred millimeters from a first end to a second end, the body having an inverted "U" shape along the length and defining a top;

a first side that extends downward from the top to a first bottom;

a second side that extends downward from the top to a second bottom that is opposite the first bottom relative to the top, wherein the first and second bottoms are spaced apart from each other;

an inner surface of the body defined along the first and second sides and the top where the first and second sides face each other, wherein the inner surface is shaped to match a shape of the top portion of the stock;

a first retention tab at the first end of the body at the first bottom and a second retention tab at the second end of the body at the first bottom that both extend inward, in a direction of the second side, and that are each configured to fit into corresponding recesses on a first side of the stock;

a first retention tab at the first end of the body at the second bottom and a second retention tab at the second end of the body at the second bottom that both extend inward, in a direction of the first side, and that are configured to fit into corresponding recesses on a second side of the stock;

wherein the at least one retention tab at the first bottom and the at least one retention tab at the second bottom are co-aligned along the length of the body and are positioned closer to the second end of the body than to the first end of the body;

wherein when the stock is in the fully collapsed position and the cheek riser is oriented with the second end closest the charging handle, the charging handle can be operated over the entire length of travel without contacting the cheek riser.

16. The detachable cheek riser of claim 14, wherein, on the inside surface of the body of the cheek riser there is a flat wall section the extends upward from the first bottom on the first side, and there is a flat wall section that extends upward from the second bottom on the second side.

17. The detachable cheek riser of claim 14, further comprising a cushion between the inside surface and an outside surface at the top of the cheek riser.

18. The detachable cheek riser of claim 14, wherein the first side, first bottom, second side, and second bottom extend along the entire length of the body.

* * * * *